US010386755B2

(12) United States Patent
Kobayashi et al.

(10) Patent No.: US 10,386,755 B2
(45) Date of Patent: Aug. 20, 2019

(54) IMAGE FORMING APPARATUS INCLUDING CLEANING OPERATION

(71) Applicant: CANON KABUSHIKI KAISHA, Tokyo (JP)

(72) Inventors: Shinsuke Kobayashi, Yokohama (JP); Takaaki Akamatsu, Yokohama (JP); Kenji Shindo, Yokohama (JP); Kohei Okayasu, Mishima (JP); Hiroki Sasame, Ichikawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/019,976

(22) Filed: Jun. 27, 2018

(65) Prior Publication Data

US 2018/0307162 A1 Oct. 25, 2018

Related U.S. Application Data

(63) Continuation of application No. 15/285,592, filed on Oct. 5, 2016, now Pat. No. 10,073,383.

(30) Foreign Application Priority Data

Oct. 6, 2015 (JP) ..... 2015-198376

(51) Int. Cl.
*G03G 15/16* (2006.01)
*G03G 21/00* (2006.01)
(Continued)

(52) U.S. Cl.
CPC ..... *G03G 15/161* (2013.01); *G03G 21/0064* (2013.01); *G03G 21/06* (2013.01); *G03G 21/08* (2013.01)

(58) Field of Classification Search
CPC ..... G03G 21/06; G03G 21/08; G03G 15/168; G03G 21/0064; G03G 15/161
See application file for complete search history.

(56) References Cited

U.S. PATENT DOCUMENTS 4,769,676 A 9/1988 Mukai et al.
5,287,149 A 2/1994 Hoshika
(Continued)

FOREIGN PATENT DOCUMENTS

CN 1150662 A 5/1997
CN 101206436 A 6/2008
(Continued)

OTHER PUBLICATIONS

Office Action issued in Application No. 1/2016/000343 in the Philippines dated Oct. 10, 2018.
(Continued)

*Primary Examiner* — Sandra Brase
(74) *Attorney, Agent, or Firm* — Rossi, Kimms & McDowell LLP

(57) ABSTRACT

An image forming apparatus includes a discharging device for discharging the drum at a discharging portion opposing the surface of the drum; and a control unit for executing, during non-image formation, a cleaning operation for transferring the toner deposited on the transfer member onto the drum by applying a voltage from transfer voltage source to the transfer member. The control unit does not effect discharge by the discharging device for at least a region of the drum where a transfer voltage for transferring a normal-polarity toner of the toner deposited on the transfer member onto the drum is applied to the transfer member in the cleaning operation, and then passes the region of the drum through the charging portion in a state in which a voltage
(Continued)

larger than a surface potential of the drum in a normal polarity side is applied to the charging member.

17 Claims, 11 Drawing Sheets

(51) Int. Cl.
*G03G 21/06* (2006.01)
*G03G 21/08* (2006.01)

(56) References Cited

U.S. PATENT DOCUMENTS

| | | | | |
|---|---|---|---|---|
| 5,697,013 | A | 12/1997 | Saski | |
| 5,752,130 | A | 5/1998 | Tanaka et al. | |
| 7,945,190 | B2 | 5/2011 | Kubo | |
| 10,073,383 | B2 * | 9/2018 | Kobayashi | G03G 15/161 |
| 2003/0147659 | A1 | 8/2003 | Yoshikawa et al. | |
| 2007/0230993 | A1 | 10/2007 | Takeuchi | |
| 2010/0196026 | A1 * | 8/2010 | Shida | G03G 15/161 399/44 |
| 2014/0348523 | A1 | 11/2014 | Hiramatsu et al. | |
| 2016/0097986 | A1 | 4/2016 | Hiramatsu et al. | |

FOREIGN PATENT DOCUMENTS

| | | | |
|---|---|---|---|
| JP | H0667491 | A | 3/1994 |
| JP | H08234545 | A | 9/1996 |
| JP | H08328440 | A | 12/1996 |
| JP | 2001249502 | A | 9/2001 |
| JP | 2004054142 | A | 2/2004 |
| JP | 2008090234 | A | 4/2008 |
| JP | 2015004958 | A | 1/2015 |
| JP | 2016071296 | A | 5/2016 |

OTHER PUBLICATIONS

Office Action issued in Chinese Appln. No. 201610868109.6 dated Aug. 28, 2018. English Translation provided.
Substantive Examination Report issued in Philippine Appln. No. 1/2016/000343 dated Jun. 28, 2018.
Quayle Action issued in U.S. Appl. No. 15/285,592 mailed Jul. 3, 2017.
Notice of Allowance issued in U.S. Appl. No. 15/285,592 dated Nov. 14, 2017.
Notice of Allowance issued in U.S. Appl. No. 15/285,592 dated Mar. 27, 2018.
Office Action issued in Korean Appln. No. 10-2016-0128229 dated Feb. 19, 2019. English Translation provided.
Office Action issued in Japanese Appln. No. 2015-198376 dated Feb. 12, 2019. English Translation provided.

* cited by examiner

IMAGE FORMING APPARATUS INCLUDING CLEANING OPERATION

FIELD OF THE INVENTION AND RELATED ART

The present invention relates to an image forming apparatus, such as a laser printer, a copying machine or a facsimile machine, using an electrophotographic recording type.

In a conventional image forming apparatus of the electrophotographic type, a photosensitive drum as an image bearing member is electrically charged uniformly, and thereafter exposure to light in accordance with an image pattern is made, so that an electrostatic latent image is formed on the photosensitive drum. Thereafter, the electrostatic latent image formed on the photosensitive drum is developed and visualized with a toner, and thereafter a resultant toner image is transferred onto a recording material such as paper. Then, a transfer residual toner remaining on the photosensitive drum is removed from the photosensitive drum and is collected.

As a means for removing and collecting the transfer residual toner from the photosensitive drum, a cleaning device including a cleaning member such as a cleaning blade has been widely used. The toner collected by the cleaning device is a waste toner, but it is desirable that the waste toner does not generate from the viewpoints of environmental protection, effective use of resources, and the like. Further, from the viewpoint of downsizing of the image forming apparatus or the like, it is desirable that the cleaning device is not provided.

Therefore, in recent years, an image forming apparatus using a "cleaner-less system" in which the transfer residual toner is removed and collected in a photosensitive drum from the photosensitive drum through "simultaneous development and cleaning" by the developing device and then is reused has been put into practical use.

Incidentally, in the conventional image forming apparatus using the cleaner-less system, the transfer residual toner remains on the photosensitive drum without being completely collected in the developing device and thus an image defect is caused in some cases. This is because in the toner as a developer, a toner charged to an opposite polarity to a normal polarity of the toner exists in mixture. Further, even the toner having the normal polarity as a charge polarity includes a toner reversed in charge polarity by a transfer bias, peeling electric discharge or the like and a toner decreased in charge amount by discharge in some cases. Accordingly, in order to collect the transfer residual toner in the developing device through the simultaneous development and cleaning with reliability, the transfer residual toner on the photosensitive drum which passed through a charging portion and which is carried to a developing portion is required that the charge polarity thereof is the normal polarity and that the transfer residual toner has a sufficient charge amount for being collected in the developing device.

In order to reverse the polarity of the toner charged to the opposite polarity to the normal polarity to the normal polarity again, there is a means such that the surface of the photosensitive drum is discharged by a discharging device before a charging process and then during the charging process, electric discharge is generated by increasing a potential difference between the photosensitive drum and a charging member. For example, in the case where the surface of the photosensitive drum is discharged and a surface potential is made −100 V uniformly and then a voltage of −1100 V is applied at the charging portion, a potential difference of 1000 V generated between the photosensitive drum and the charging member. By electric discharge generating at the developing portion, the transfer residual toner charged to the opposite polarity can be reversed in polarity to the normal polarity again.

As the image forming apparatus using the cleaner-less system, a constitution in Japanese Laid-Open Patent Application (JP-A) 2004-54142 is disclosed. In the constitution in JP-A 2004-54142, a control member for charging the transfer residual toner to have a desired charge amount is provided on the photosensitive drum. Further, in a side upstream of a charging means and downstream of the control member, an urethane sheet for once blocking and uniformizing the transfer residual toner is provided on the photosensitive drum.

However, in the image forming apparatus using the cleaner-less system as disclosed in JP-A 2004-54142, there was a problem such that the transfer residual toner was fused on the photosensitive drum and caused image defect without being completely collected in the developing device.

For example, when the toner charged to the normal polarity by cleaning of the transfer member during non-image formation is moved on the photosensitive drum, a part of this toner is excessively charged to the normal polarity at a charging process portion. Then, this excessively charged toner was attracted to the photosensitive drum by its own image charge generating on the photosensitive drum and was deposited on the photosensitive drum (drum fusion). As a result, there was a problem that the transfer residual toner could not be collected by the developing device and then during subsequent image formation, image defect such that the toner passed through the developing portion was placed on an image generated. Or, image defect such that the toner on a developing roller was deposited on a drum fusion portion and thus a portion where the toner was deposited was formed in a dot shape in an unintended region generated. Or, there was a problem that the drum fusion portion caused excessive electric discharge by an excessively low electric resistance during the charging process and thus a white void ($\alpha$ portion where a dot-shaped toner was not deposited) was formed in the unintended region generated.

SUMMARY OF THE INVENTION

A principal object of the present invention is to provide an image forming apparatus capable of suppressing drum fusion and image defect by providing a stable charge amount without excessively charging a transfer residual toner while maintaining a charge polarity of the transfer residual toner at a normal polarity.

According to an aspect of the present invention, there is provided an image forming apparatus including a rotatable image bearing member, a charging member for electrically charging the image bearing member at a charging portion opposing the image bearing member by being supplied with a charging voltage from a charging voltage source, a developing member for forming a toner image at a developing portion opposing the image bearing member by being supplied with a developing voltage from a developing voltage source thereby to supply a toner charged to a normal polarity to the image bearing member, and a transfer member for transferring the toner image from the image bearing member onto a toner image receiving member at a transfer portion opposing the image bearing member by being supplied with a transfer voltage from a transfer voltage source, wherein the image forming apparatus is capable of collecting the toner remaining on a surface of the image bearing member after passing through the transfer portion by the developing member, the image forming apparatus comprising: a discharging device for discharging the image bearing member at a discharging portion opposing the surface of the image bearing member after passing through the transfer portion and before reaching the charging portion; and a control unit for executing, during non-image formation, a cleaning operation for transferring the toner deposited on the transfer member onto the image bearing member by applying a voltage from transfer voltage source to the transfer member, wherein the control unit does not effect discharge by the discharging device for at least a region of the image bearing member where a transfer voltage for transferring a normal-polarity toner of the toner deposited on the transfer member onto the image bearing member is applied to the transfer member in the cleaning operation of the transfer member, and then passes the region of the image bearing member through the charging portion in a state in which a voltage larger than a surface potential of the image bearing member in a normal polarity side is applied to the charging member.

Further features of the present invention will become apparent from the following description of exemplary embodiments with reference to the attached drawings.

DESCRIPTION OF THE EMBODIMENTS

Embodiments of the present invention will be specifically described with reference to the drawings. Dimensions, materials, shapes and relative arrangements of constituent elements described in the following embodiments should be appropriately be changed depending on structures and various conditions of devices (apparatuses) to which the present invention is applied. Accordingly, the scope of the present invention is not intended to be limited to the following embodiments unless otherwise specified.

Embodiment 1

<Image Forming Apparatus>

Figure 1:
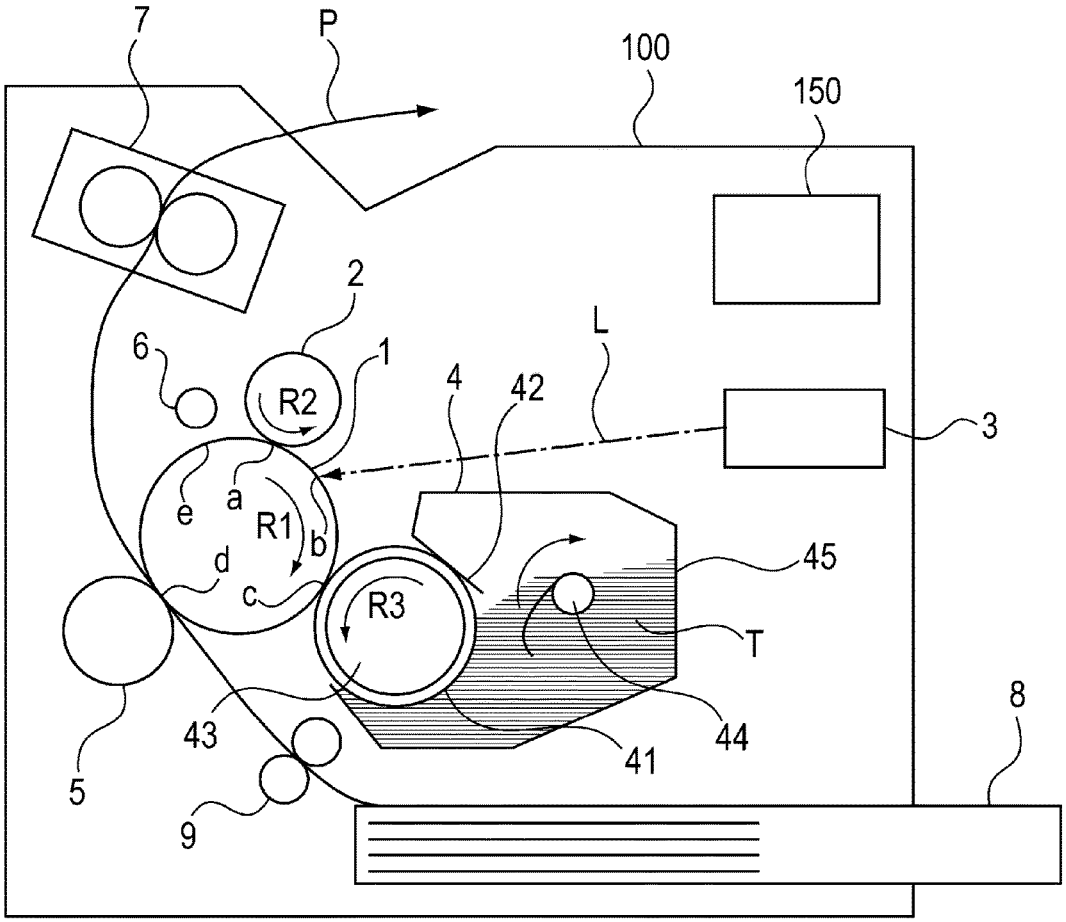
FIG. 1 is an illustration of an image forming apparatus in Embodiment 1.

FIG. 1 is a schematic structural view of an image forming apparatus 100 in Embodiment 1 of the present invention. In this embodiment, the image forming apparatus 100 is illustrated as a laser beam printer of an electrophotographic type employing a cleaner-less system and a contact charging type.

As shown in FIG. 1, the image forming apparatus 100 includes a photosensitive drum 1 which is a drum-shaped (cylindrical) electrophotographic photosensitive member as a rotatable image bearing member. When an image outputting operation is started, the photosensitive drum 1 is rotationally driven by an unshown driving motor in an arrow R1 direction indicated in FIG. 1. A surface of the rotating photosensitive drum 1 is electrically charged uniformly to a predetermined polarity (negative (polarity) in this embodiment) and a predetermined potential by a charging roller which is a roller-shaped charging member as a charging means. The charging roller 2 is provided in contact with the photosensitive drum 1 and is rotationally driven by an unshown driving motor in an arrow R2 direction indicated in FIG. 1. At this time, to the charging roller 2, a predetermined charging voltage (charging bias) which is a negative DC voltage is applied from a charging voltage source E1 (FIG. 2) as a charging voltage applying means. A contact portion between the photosensitive drum 1 and the charging roller 2 is a charging nip a. Further, with respect to a rotational direction of the photosensitive drum 1, a position where the photosensitive drum 1 is charged by the charging roller 2 is a charging portion. The charging roller 2 charges the surface of the photosensitive drum 1 by electric discharge generating in at least one of gaps formed between the charging roller 2 and the photosensitive drum 1 in an upstream side and a downstream side of the charging nip a with respect to the rotational direction of the photosensitive drum 1. In this embodiment, for convenience of easy understanding, the charging process of the surface of the photosensitive drum 1 is deemed to be performed at the charging nip, and the charging nip is described as the charging portion a in some cases.

The surface of the charged photosensitive drum 1 is subjected to scanning exposure to a laser beam L modulated depending on image data by an exposure device (laser exposure unit) 3 as an exposure means (electrostatic image forming means). The exposure device 3 forms an electrostatic latent image on the photosensitive drum 1 by subjecting the photosensitive drum surface to exposure to the laser beam 1 also with respect to sub-scanning direction (surface movement direction) while repeating the exposure with respect to a main scanning direction (rotational axis direction) of the photosensitive drum 1. With respect to the rotational direction of the photosensitive drum 1, an exposure position of the photosensitive drum 1 by the exposure device 3 is an image exposure portion b.

The electrostatic latent image formed on the photosensitive drum 1 is developed (visualized) as a toner image with a toner as a developer by a developing device 4 as a developing means. The developing device 4 includes a developing container 45 and a developing sleeve 41 as a developing member (developer carrying member) rotatably supported by the developing container 45. A toner T of black which is a magnetic one-component developer as the developer is accommodated. The toner T in this embodiment is negatively chargeable. That is, in this embodiment, a normal polarity (charge polarity during development) of the toner T is negative. The developing sleeve 41 is disposed at an opening provided at an opposing position of the developing container 45 to the photosensitive drum 1 so as to be partly exposed to an outside of the developing container 45. The developing sleeve 41 is prepared by providing an electroconductive elastic rubber layer having a predetermined volume resistivity at a periphery of a hollow non-magnetic metal (such as aluminum) bare tube. At a hollow portion of the developing sleeve 41, a magnet roller 43 as a magnetic field generating means is fixedly provided.

The toner T accommodated in the developing container 45 is not only stirred by a stirring member 44 but also supplied to the surface of the developing sleeve 41 by a magnetic force of the magnet roller 43. The toner T supplied to the surface of the developing sleeve 41 passes through an opposing portion to the developing blade 42 as a developer regulating member with rotation of the developing sleeve 41, so that the toner T is formed uniformly in a thin layer and is negatively charged triboelectrically. Thereafter, the toner on the developing sleeve 41 is fed to the developing position, where the developing sleeve 41 contacts the photosensitive drum 1, with the rotation of the developing sleeve 41, and is transferred onto the photosensitive drum 1 depending on the electrostatic latent image on the photosensitive drum 1, so that the electrostatic latent image on the photosensitive drum 1 is developed with the toner. At this time, to the developing sleeve 41, a predetermined developing voltage (developing bias) which is a negative DC voltage is applied from a developing voltage source E2 (FIG. 2) as a developing voltage applying means. In this embodiment, the toner image is formed by image portion exposure and reverse development. That is, the photosensitive drum surface is exposed to light after being uniformly charged, whereby the toner charged to the same polarity (negative in this embodiment) as the charge (potential) polarity of the photosensitive drum 1 is deposited on an exposed portion (image portion) on the photosensitive drum 1 decreased in absolute value of the potential.

With respect to the rotational direction of the photosensitive drum 1, a position where the photosensitive drum 1 opposes (contacts) the developing sleeve 41 is a developing portion c.

In this embodiment, the developing sleeve 41 is rotationally driven in an arrow R3 direction (FIG. 1) by an unshown driving motor so that movement directions of the photosensitive drum 1 and the developing sleeve 41 are the same direction at the developing portion c.

The toner image formed on the photosensitive drum 1 is sent to a transfer portion d which is a contact portion between the photosensitive drum 1 and a transfer roller 5 which is a roller-shaped transfer member as a transfer means. In synchronism with timing of the toner image on the photosensitive drum 1, a recording material P such as a recording sheet which is a toner image receiving member is sent from an accommodating portion 8 to the transfer portion d by a feeding roller 9 and the like. Then, the toner image on the photosensitive drum 1 is transferred at the transfer portion d by the action of the transfer roller 5 onto the recording material P sandwiched between the photosensitive drum 1 and the transfer roller 5. At this time, to the transfer roller 5, from a transfer voltage source E3 (FIG. 2) as a transfer voltage applying means, a predetermined transfer voltage (transfer bias) which is a DC voltage of the opposite polarity (positive in this embodiment) to the normal polarity of the toner is applied. As a result, the toner image is electrostatically transferred from the photosensitive drum 1 onto the recording material P by the action of an electric field formed between the transfer roller 5 and the photosensitive drum 1.

The recording material P on which the toner image is transferred is sent to a fixing device 7 as a fixing means. In the fixing device 7, heat and pressure are applied to the recording material P, so that the toner image transferred on the recording material P is fixed on the recording material P.

On the other hand, a transfer residual toner (remaining toner) remaining on the photosensitive drum 1 without being transferred onto the recording material P is collected in the developing device 4 by simultaneous development and cleaning. That is, the developing device 4 not only has a function of being supplied with a voltage thereby to supply the toner T charged to the normal polarity to the electrostatic latent image on the photosensitive drum 1 at the developing portion c but also has a function of collecting the toner residual toner remaining on the photosensitive drum 1 after the transfer. Details of the simultaneous development and cleaning will be described hereinafter.

Here, the image forming apparatus 100 performs a series of image outputting operation (job) steps which are started by an instruction from an unshown external device and in which a single or a plurality of recording materials P are subjected to image formation. In general, the job includes an image forming step (printing step), a pre-rotation step, a sheet interval (recording material interval) step in the case where the images are formed on the plurality of recording materials P, and a post-rotation step. The image forming step is performed in a period in which formation of the electrostatic latent image on the photosensitive drum 1, development of the electrostatic latent image, transfer of the toner image, fixing of the toner image and the like are carried out in actuality. Specifically, timing of the image forming step varies depending on positions where the respective steps of charging, exposure, development, transfer, fixing and the like are performed. The pre-rotation step is performed in a period in which a preparatory operation is carried out before the image forming step. The sheet interval step is performed in a period corresponding to an interval between a recording material P and a subsequent recording material P at the transfer portion d when a plurality of image forming steps are continuously performed with respect to a plurality of recording materials P. The post-rotation step is performed in a period in which a post-operation (preparatory operation) after the image forming step is carried out. The image forming step is performed during image formation, and periods, other than during the image formation, such as those of the pre-rotation step, the sheet interval step, the post-rotation step and the like correspond to during non-image formation. In this embodiment, at predetermined timing during the non-image formation, a cleaning operation for transferring the toner deposited on the transfer roller 5 onto the photosensitive drum 1 is carried out.

<Simultaneous Development and Cleaning>

Details of the simultaneous development and cleaning will be described. In the image forming apparatus 100 in this embodiment, a pre-exposure device 6 as a discharging (charge-removing) device for discharging (charge-removing) the photosensitive drum 1 is provided in a side downstream of the transfer portion d and upstream of the charging portion a with respect to the rotational direction of the photosensitive drum 1. The pre-exposure device 6 optically discharges the surface potential of the photosensitive drum 1 before an associated region of the photosensitive drum 1 enters the charging portion a in order to generate stable electric discharge at the charging portion a. In the pre-exposure device 6 in this embodiment, a constitution in which the photosensitive drum 1 is directly irradiated with light of an LRD as a pre-exposure means is shown as an example. An exposure position by the pre-exposure device 6 is a discharging portion e with respect to the rotational direction of the photosensitive drum 1. The transfer residual toner includes a toner charged to an opposite polarity to the normal polarity, and a toner which is charged to the normal polarity but which does not have a sufficient electric charge in the form of a mixture. As regards these toners, the photosensitive drum 1 after the transfer is discharged by the pre-exposure device 6, and uniform electric discharge is generated during the charging process, whereby, it becomes possible to electrically charge again the transfer residual toner to the normal polarity.

The toner charged to the negative polarity at the charging portion a is sent to the developing portion c with the rotation of the photosensitive drum 1. In a non-image region (non-exposure region), by a potential difference between a dark portion potential (Vd) of the surface of the photosensitive drum 1 and a developing bias (Vdc), the toner sent to the developing portion c is transferred onto the developing sleeve 41 and then is collected in the developing device 4. On the other hand, in an image region (exposed region), by a potential difference between a light portion potential (V1) of the surface of the photosensitive drum 1 and the developing bias (Vdc), the toner sent to the developing portion c is not transferred onto the developing sleeve 41, but is sent to the transfer portion d as it is as an image portion with the rotation of the photosensitive drum 1, and thereafter is transferred onto the recording material P. Incidentally, Vdc is set at a potential between Vd and Vl.

<Control Manner>

Figure 2:
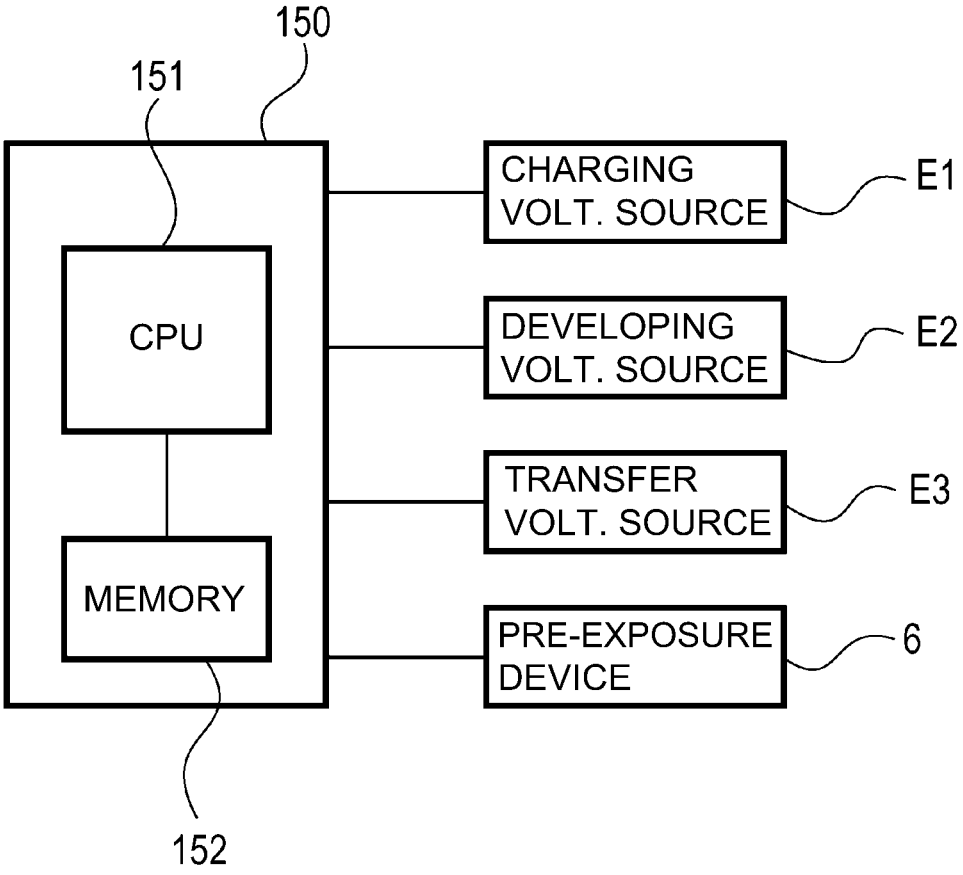
FIG. 2 is a schematic diagram showing a control manner of the image forming apparatus in Embodiment 1.

FIG. 2 is a block diagram showing a schematic control manner (mode) of a principal part of the image forming apparatus 100 in this embodiment. A controller 150 as a control unit provided in the image forming apparatus 100 is constituted by including CPU 151 which is a central element (device) for performing computation and including a memory 152, such as ROM or RAM, as a storing element (device). In the RAM, a detection result of a sensor, a computation result, and the like are stored, and in the ROM, a control program, a data table obtained in advance, and the like are stored. The controller 150 is the control unit for effecting integrated control of the operation of the image forming apparatus 100, and controls transfer of various electrical information signals, driving timing and the like, and thus effects predetermined image forming sequence control and the like. With the controller 150, respective objects to be controlled are connected. For example, the charging voltage source E1, the developing voltage source E2, the transfer voltage source E3, the pre-exposure device 6 and the like are connected with the controller 150. Particularly, in this embodiment, the controller 150 executes the cleaning operation of the transfer roller 5 described later by controlling ON/OFF and output values of the various voltage sources E1, E2 and E3 and ON/OFF of irradiation with discharging light, and the like.

<Cleaning Operation of Transfer Roller>

As described above, the transfer residual toner on the photosensitive drum 1 is collected in the developing device 4 in the non-image region, and is transferred onto the recording material P in the image region in the following period. However, in the case where, for example, a job for continuously passing a plurality of recording materials through the transfer portion d is performed, the transfer roller 5 is contaminated with a fog toner by collecting the fog toner from the photosensitive drum 1 during the sheet interval step. The fog toner is a toner deposited on the photosensitive drum 1 in the non-image region. In the fog toner, due to surface potential non-uniformity or the like on the photosensitive drum 1, the toner which is charged to the normal polarity and which is transferred on the photosensitive drum 1, the toner which is not completely charged to the normal polarity, and the toner charged to the opposite polarity to the normal polarity exist in mixture. These fog toners are transferred onto the transfer roller 5 at the transfer portion d by electrostatic or physical sliding (friction). In this embodiment, the transfer roller 5 is formed with an electroconductive sponge-shaped rubber and is 12.5 mm in outer diameter and 30° in hardness (Asker-C, 500 gf load).

In the case where the fog toner accumulates on the transfer roller 5, in a subsequent image outputting operation, image defect such as back surface contamination of the recording material P generates, and therefore in this embodiment, a cleaning operation of the transfer roller 5 is performed in a post-rotation step. Specifically, the surface of the photosensitive drum 1 is placed in a dark-portion potential (−700 V) state uniformly by a charging bias (−1200 V). In this state, a bias (−200 V) higher than the dark-portion potential (−700 V) in a positive side and a bias (−1200 V) higher than the dark-portion potential (−700 V) in a negative side are alternately applied to the transfer roller 5. As a result, each of the toners of the positive and negative polarities deposited on the transfer roller 5 is electrostatically attracted to the surface of the photosensitive drum 1 and thus is transferred onto the photosensitive drum 1. The image forming apparatus 100 in this embodiment is capable of sufficiently transfer the fog toner contained in the transfer roller 5 onto the photosensitive drum 1 by repeating 2 times application of the transfer biases higher in the positive and negative sides (than the dark-portion potential) in the cleaning operation performed in the post-rotation step.

<ON-OFF Control of Pre-Exposure Device 6>

Figure 3:
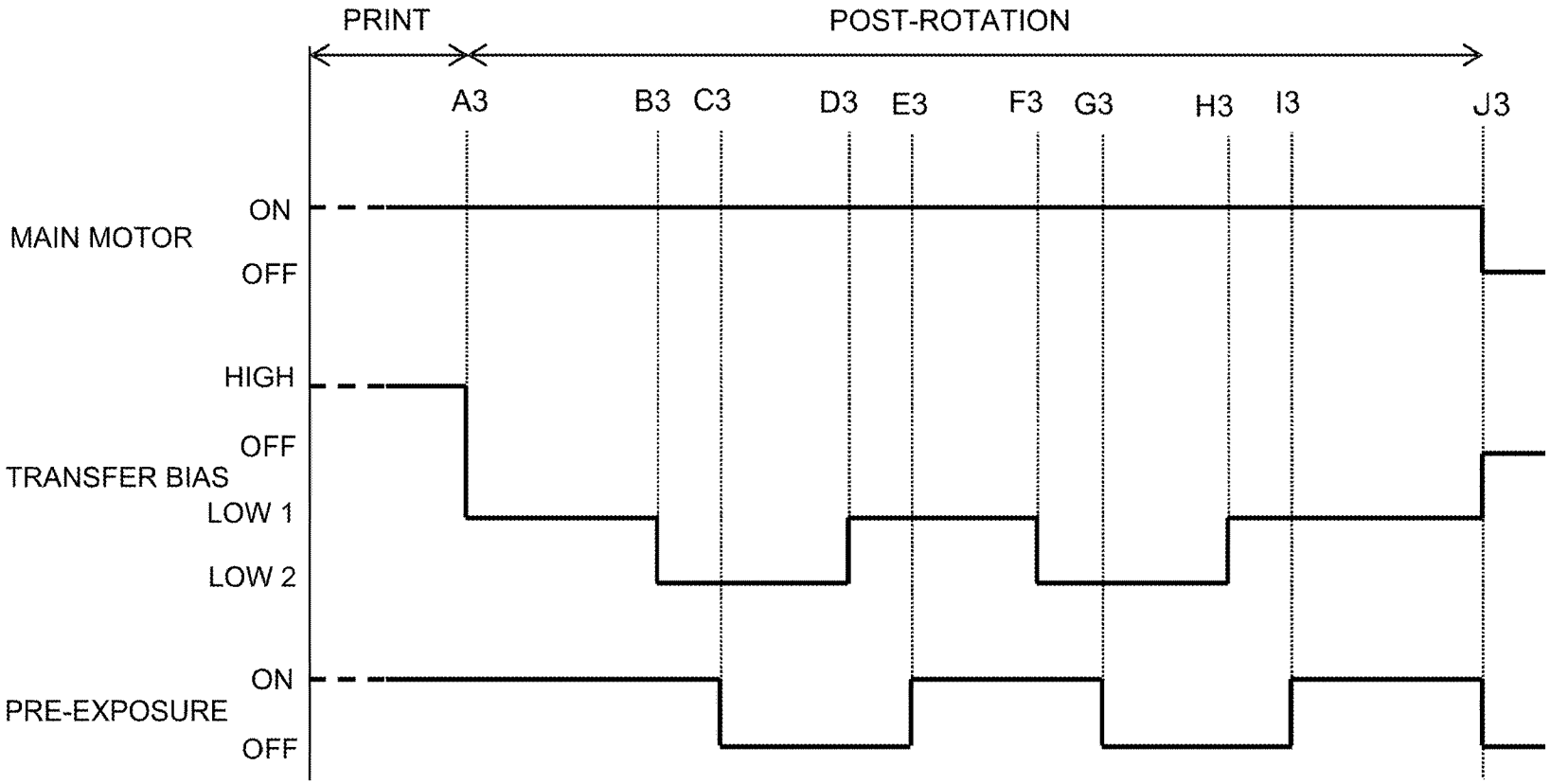
FIG. 3 is a timing chart of a cleaning operation in Embodiment 1.

FIG. 3 is a timing chart of the cleaning operation of the transfer roller 5 in this embodiment. The cleaning operation of the transfer roller 5 is executed by controlling the operations of the respective portions by the controller 150 at timing shown in FIG. 3. In this embodiment, in the case where the number of sheets subjected to image output is not less than a predetermined threshold, in the post-rotation step, the cleaning operation of the transfer roller 5 is carried out.

In this embodiment, as the transfer bias, the following 3 biases "HIGH", "LOW1" and "LOW2" are used.

HIGH: Image trailing end bias . . . +1000 V

LOW1: Cleaning bias 1 . . . −200 V

LOW2: Cleaning bias 2 . . . −1200 V

Figure 4:
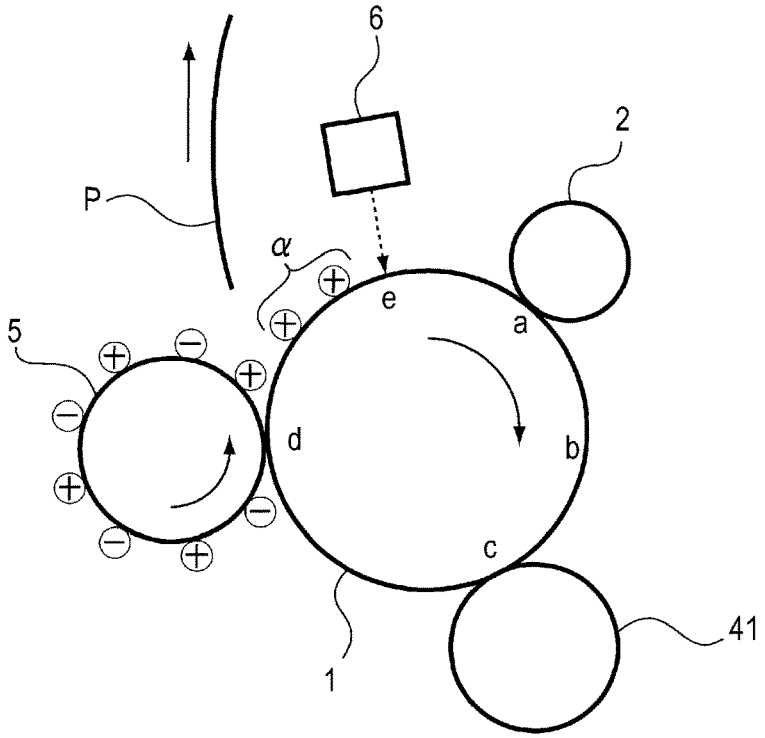
FIGS. 4 to 12 are schematic views each for illustrating a state during the cleaning operation in Embodiment 1.
Figure 5:
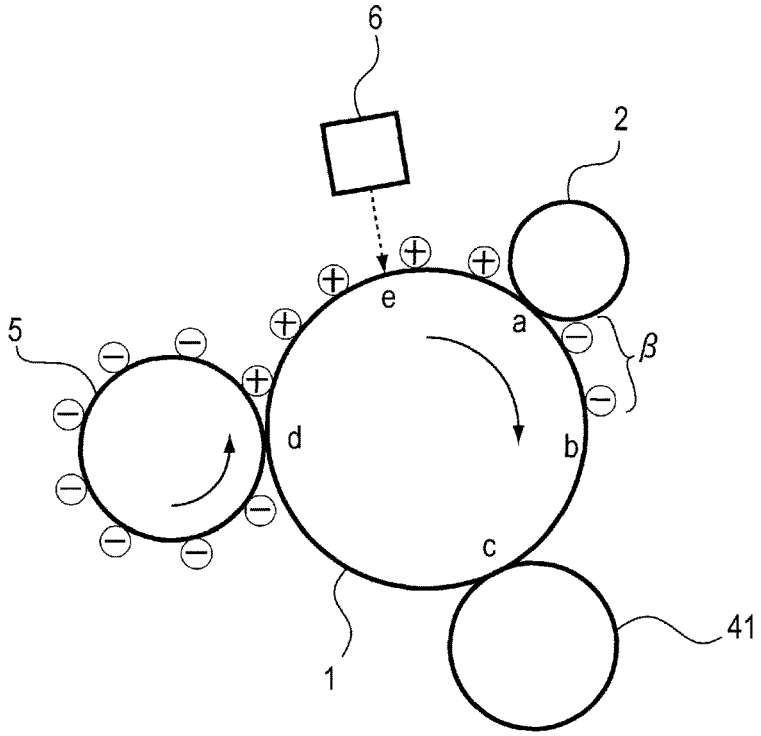

Timing (A3):

The printing step is ended, and then from timing (A3 of FIG. 3) when the recording material P passed through the transfer portion d, the sequence enters the post-rotation step. At this timing, the transfer bias is switched from HIGH (+1000 V) to LOW1 (−200 V). The surface potential on the photosensitive drum 1 after the printing step is uniformly the dark-portion potential (−700 V). For this reason, after the recording material P passed through the transfer portion d, of the toners contained in the transfer roller 5, the positive (polarity) toner is principally electrostatically attracted to the surface of the photosensitive drum 1, so that the positive toner is transferred from the transfer roller 5 onto the photosensitive drum 1 (α of FIG. 4). At this time, the pre-exposure device 6 is kept in ON state, and therefore the surface potential on the photosensitive drum 1 after the switching of the transfer bias is kept at −700 V in a section from the transfer portion d to the discharging portion e and is changed to −100 V through the optical discharge by the pre-exposure device 6 after the passing through the discharging portion e. Thereafter, at the charging portion a, by uniform electric discharge by the charging process, the surface potential on the photosensitive drum 1 is charged uniformly to −700 V. Further, at the charging portion a, with electric discharge between the photosensitive drum 1 and the charging roller 2 to which the charging bias (−1200 V) is applied, the positive toner transferred from the transfer roller 5 onto the photosensitive drum 1 is charged to the negative polarity (β of FIG. 5).

Figure 6:
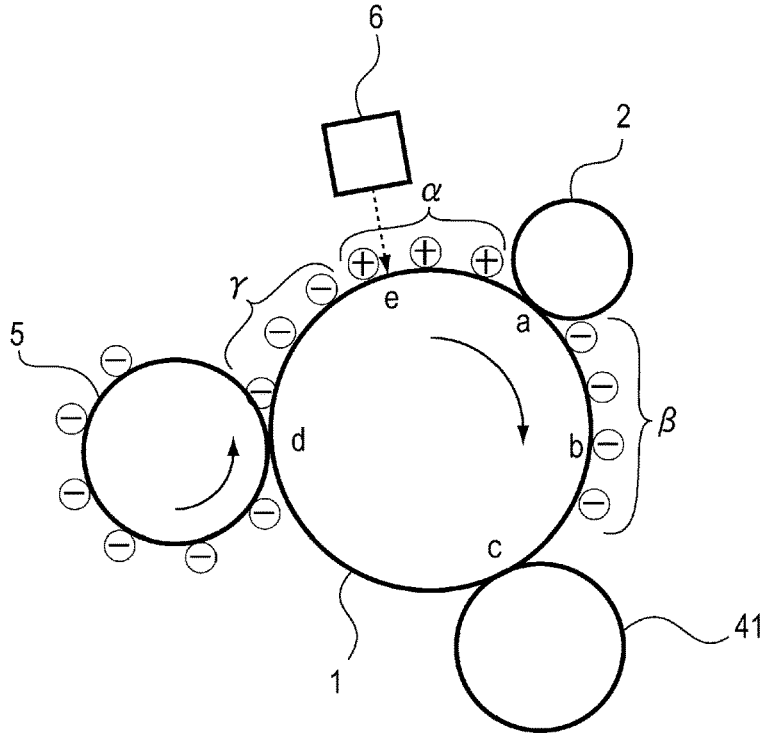

Timing (B3):

Then, at timing (B3 of FIG. 3) when the photosensitive drum 1 is rotated corresponding to about one-full-circumference of the transfer roller 5 after the transfer bias is switched to LOW1, the transfer bias is switched from LOW1 (−200 V) to LOW2 (−1200 V). At the transfer portion d, the surface potential on the photosensitive drum 1 is changed uniformly to 700 V by electric discharge at the charging portion a. For this reason, from the timing (B3 of FIG. 3) when the transfer bias is switched to LOW2, of the toners contained in the transfer roller 5, the negative (polarity) toner is principally electrostatically attracted to the surface of the photosensitive drum 1, so that the negative toner is transferred from the transfer roller 5 onto the photosensitive drum 1 (γ of FIG. 6). Accordingly, on the photosensitive drum 1, the negative toner (γ of FIG. 6) transferred from the transfer roller 5 after the switching to LOW2 follows the positive toner (α of FIG. 6) transferred from the transfer roller 5 after the transfer bias is LOW1 in a downstream side as shown in FIG. 6. Also at this time, similarly, the positive toner (α of FIG. 6) is charged to the negative polarity (β of FIG. 6) by the electric discharge at the charging portion a.

Incidentally, the timing when the transfer bias is switched from LOW1 to LOW2 may preferably be at least timing after rotation of the transfer roller 5 through one-full-circumference in order to enable cleaning of a full circumference of the transfer roller 5. Further, the transfer bias value is −200 V for LOW1 and −1200 V for LOW2, but is not limited thereto. These transfer bias values may only be required to be higher voltages in the positive side and in the negative side with reliability against a variation in surface potential (−700 V) of the photosensitive drum 1. Further, these transfer bias values may only be required to be bias values such that the positive and negative toners contained in the transfer roller 5 are alternately transferred onto the photosensitive drum 1 by the switching of the transfer bias.

Figure 7:
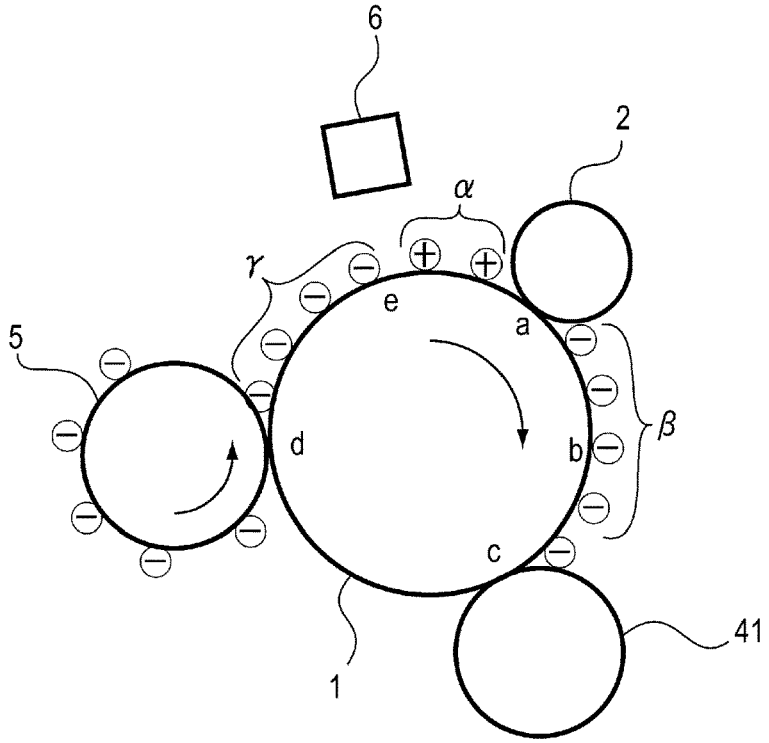

Timing (C3):

Then, at timing (C3 of FIG. 3) when the positive toner (α) transferred from the transfer roller 5 onto the photosensitive drum 1 when the transfer bias is LOW1 has completely passed through the discharging portion e, the pre-exposure device 6 is turned off. From this timing, the optical discharge is not effected at the discharging portion e, and therefore the surface potential of the photosensitive drum 1 is kept at −700 V. That is, the timing (C3) is timing when a portion positioned at the transfer portion d at the timing (B3) of the photosensitive drum 1 has reached the discharging portion e. That is, the surface potential of the photosensitive drum 1 in a region where the positive toner (α) exists in FIG. 7 is charged to −100 V by the optical discharge at the discharging portion e. On the other hand, the surface potential of the photosensitive drum 1 in a region where a subsequent negative toner (γ) exists is not subjected to optical discharge at the discharging portion e, and therefore, the photosensitive drum 1 rotates while keeping the surface potential of −700 V even after the portion of the photosensitive drum 1 passed through the discharging portion e. The region of the photosensitive drum 1 where the surface potential of −700 V is kept little causes the electric discharge since a potential difference between the region of the photosensitive drum 1 and the charging roller (−1200 V) is small, i.e., about 500 V at the charging portion a. Thus, when the region where the positive toner (α) exists and the region where the negative toner (γ) exists pass through the charging portion a, to the charging roller 2, the voltage of −1200 V larger than the image bearing member (photosensitive drum) surface potential of −700 V in the normal polarity (negative polarity) side is applied. Accordingly, the positive toner (α) is charged to the negative polarity (β of FIG. 7) by the electric discharge at the charging portion a, and the subsequent negative toner (γ) passes through the charging portion a as it is without being less subjected to the electric discharge at the charging portion a. As a result, the toners passed through the charging portion a can have stable negative electric charges irrespective of the positive and negative polarities thereof before passed through the charging portion a. Then, both of these toners are transferred onto the developing sleeve 41 at the developing portion c by a potential difference between the voltage (−1200 V) and the developing bias (−300 V), and thus are collected in the developing device 4. Incidentally, the developing bias in this embodiment is −300 V, but can also be appropriately changed in order to more facilitate electrostatic attraction of the negative toner on the photosensitive drum 1.

Figure 8:
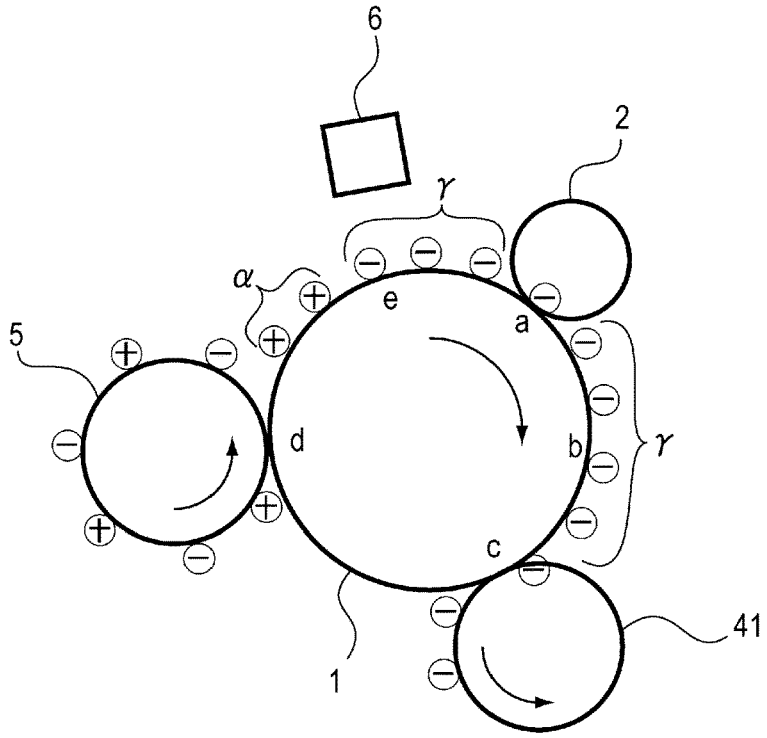

Timing (D3):

Then, at timing (D3 of FIG. 3) when the photosensitive drum 1 is rotated corresponding to about one-full-circumference of the transfer roller 5 after the transfer bias is switched to LOW2, the transfer bias is switched from LOW2 (−1200 V) to LOW1 (−200 V). Also at this time, similarly, the surface potential on the photosensitive drum 1 at the transfer portion d is changed uniformly to 700 V. For this reason, from the timing (D3 of FIG. 3) when the transfer bias is switched to LOW1, the positive toner remaining in the transfer roller 5 is electrostatically attracted to the surface of the photosensitive drum 1, so that the positive toner is transferred from the transfer roller 5 onto the photosensitive drum 1 (α of FIG. 8). Accordingly, on the photosensitive drum 1, the positive toner (α) follows the negative toner (γ) in a downstream side as shown in FIG. 8. The negative toner (γ) is the toner transferred from the transfer roller 5 onto the photosensitive drum 1 when the transfer bias is LOW2, and the positive toner (α) is the toner transferred from the transfer roller 5 onto the photosensitive drum 1 after the transfer bias is switched to LOW1.

Figure 9:
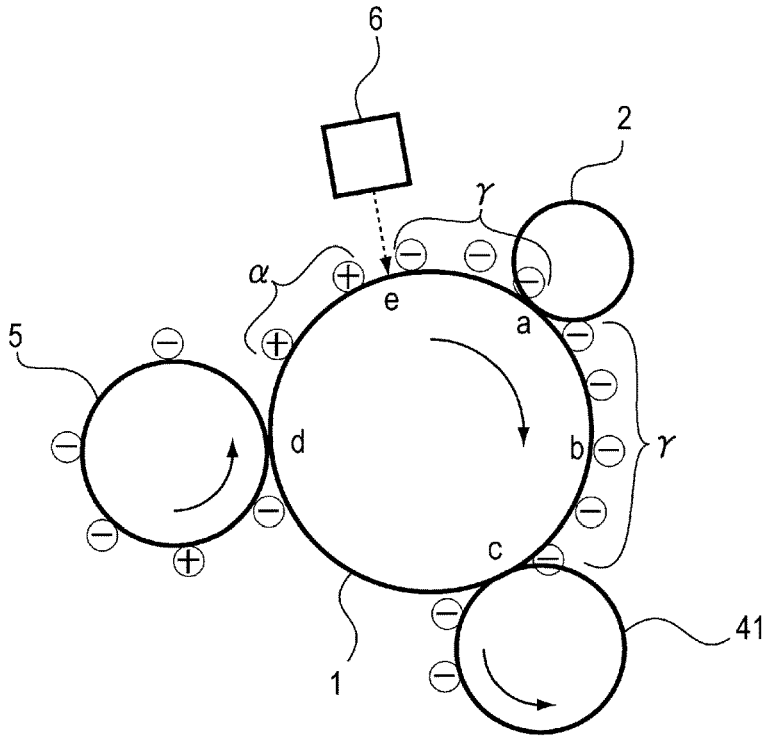

Timing (E3):

Then, at timing (E3 of FIG. 3) when the positive toner (α) transferred from the transfer roller 5 onto the photosensitive drum 1 after the transfer bias is switched to LOW1 reaches the discharging portion e, the pre-exposure device 6 is turned on again. The timing (E3) is timing which a portion positioned at the transfer portion d at the timing (D3) of the photosensitive drum 1 reaches the discharging portion e. From this timing, the optical discharge is effected again at the discharging portion e, so that the surface potential on the photosensitive drum 1 is changed to −100 V. That is, in FIG. 9, the surface potential of the photosensitive drum 1 in the region where the negative toner (γ) exists is −700 V, and the surface potential of the photosensitive drum 1 in the region where the subsequent positive toner (α) exists is changed to −100 V after passing through the discharging portion e. As a result, the positive toner (α) is charged to the negative polarity by the electric discharge at the charging portion a, and therefore, is transferred onto the developing sleeve 41 at the developing portion c and then is collected in the developing device 4.

Figure 10:
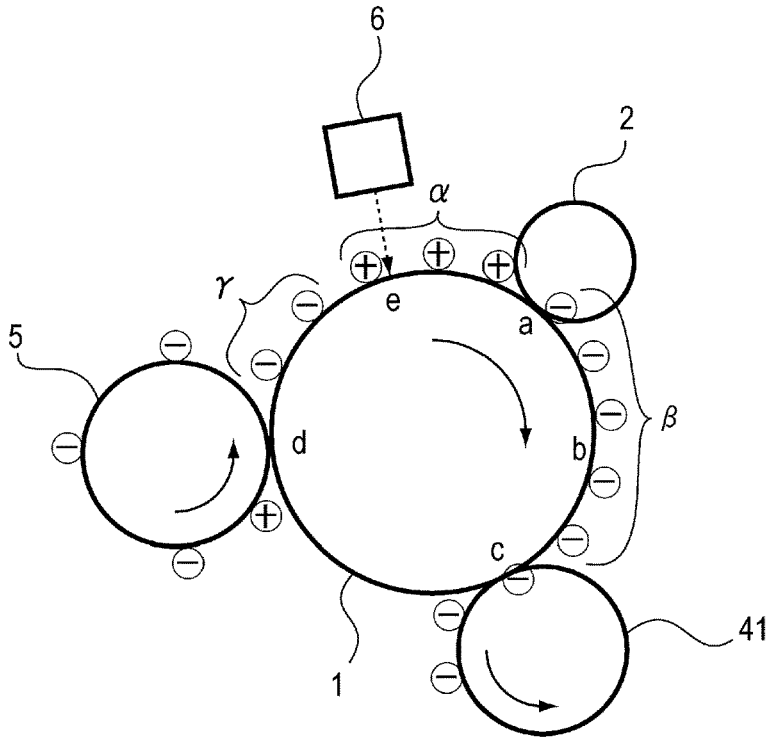

Timing (F3):

Then, at timing (F3 of FIG. 3) when the photosensitive drum 1 is rotated corresponding to about one-full-circumference of the transfer roller 5 after the transfer bias is switched again to LOW1, the transfer bias is switched from LOW1 (−200 V) to LOW2 (−1200 V). The purpose of this operation is similar to that at the timing (B3), and from this timing, the negative toner remaining in the transfer roller 5 is electrostatically attracted to the surface of the photosensitive drum 1, so that the negative toner is transferred from the transfer roller 5 onto the photosensitive drum 1 (γ of FIG. 10). Accordingly, on the photosensitive drum 1, the negative toner (γ of FIG. 10) follows the positive toner (α of FIG. 10) in a downstream side as shown in FIG. 10. The positive toner (α) is the toner transferred from the transfer roller 5 onto the photosensitive drum 1 when the transfer bias is LOW1, and the negative toner (γ) is the toner transferred from the transfer roller 5 onto the photosensitive drum 1 after the transfer bias is switched to LOW2. Also at this time, similarly as in the case of the timing (E3), the positive toner (α of FIG. 10) is charged to the negative polarity (β of FIG. 10) by the electric discharge at the charging portion a.

Figure 11:
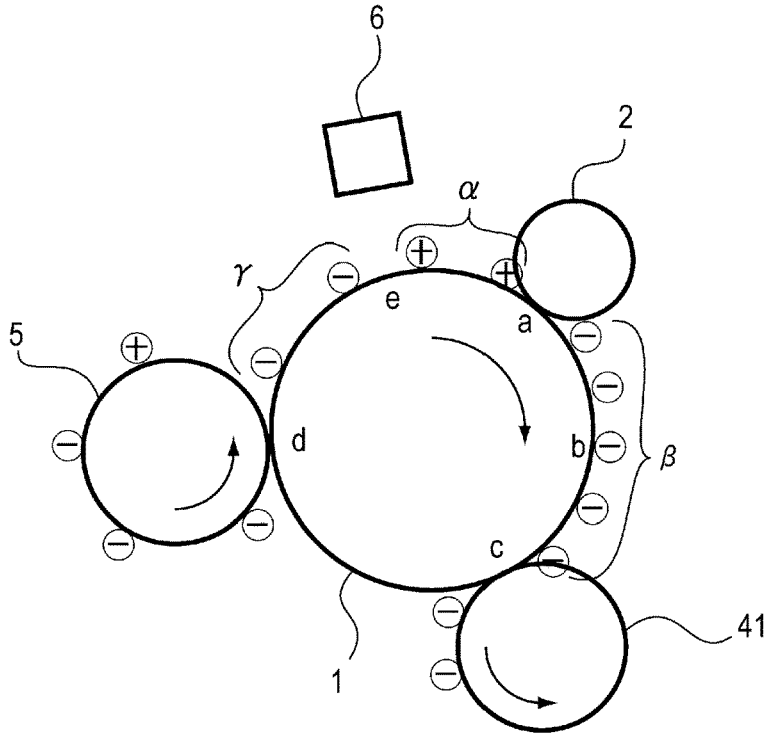

Timing (G3):

Then, at timing (G3 of FIG. 3) when the positive toner (α) transferred from the transfer roller 5 onto the photosensitive drum 1 when the transfer bias is LOW1 has completely passed through the discharging portion e, the pre-exposure device 6 is turned off again. The timing (G3) is timing when a portion positioned at the transfer portion d at the timing (of the photosensitive drum 1 has reached the discharging portion e. The purpose of this operation is similar to that at the timing (C3), and from this timing, the optical discharge is not effected at the discharging portion e, and therefore the surface potential of the photosensitive drum 1 is kept at −700 V. That is, in FIG. 11, the surface potential of the photosensitive drum 1 in the region where the positive toner (α) exists is −100 V, and the photosensitive drum 1 rotates while keeping the surface potential of the photosensitive drum 1, in the region where the subsequent negative toner (γ) exists, at −700 V even after passed through the discharging portion e. Behaviors of the positive toner (α) and the negative toner (γ) are similar to those at the timing (C3), i.e., each of the toners is transferred onto the developing sleeve 41 while having stable negative electric charges and then is collected in the developing device 4.

Figure 12:
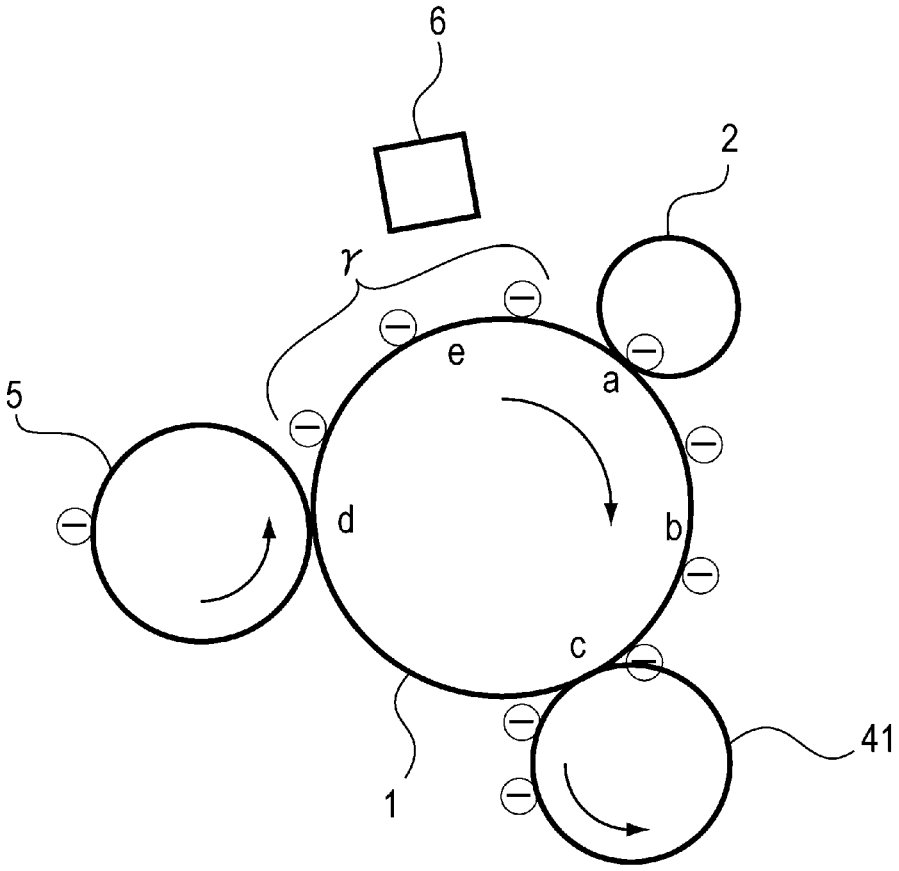

Timing (H3):

Then, at timing (H3 of FIG. 3) when the photosensitive drum 1 is rotated corresponding to about one-full-circumference of the transfer roller 5 after the transfer bias is switched again to LOW2, the transfer bias is switched from LOW2 (−1200 V) to LOW1 (−200 V). At this timing, as shown in FIG. 12, the negative toner contained in the transfer roller 5 is substantially removed, and the remaining positive toner is transferred from the transfer roller 5 onto the photosensitive drum 1.

Timing (I3)

Then, at timing (I3 of FIG. 3) when the positive toner (α) remaining in the transfer roller 5 reaches the discharging portion e after the transfer bias is switched to LOW1, the pre-exposure device 6 is turned on again. The timing (I3) is timing when a portion positioned at the transfer portion d at the timing (H) of the photosensitive drum 1 has reached the discharging portion e. As a result, the region where the positive toner (α) transferred from the transfer roller 5 onto the photosensitive drum 1 is discharged at the discharging portion e, and further, the positive toner is charged to the negative polarity by the electric discharge at the charging portion a and then is collected in the developing device 4.

Timing (J3):

Finally, at timing (J3 of FIG. 3) when all the negative toners (γ of FIG. 12) transferred from the transfer roller 5 when the transfer bias is LOW2 are collected in the developing device 4, the transfer bias and drive of all of the unshown high-voltage sources, a main motor, a scanner motor and the like are turned off, so that the post-rotation step is ended.

Functional Effect of this Embodiment

As described above, according to this embodiment, in the cleaning operation of the transfer roller 5 in the post-rotation step, the pre-exposure device 6 is turned on and off depending on the polarity of the toners transferred from the transfer roller 5 onto the photosensitive drum 1. That is, when the positive toner is transferred from the transfer roller 5 onto the photosensitive drum 1, uniform electric discharge is generated during the charging process after the optical discharge by the pre-exposure device 6 is effected. Further, when the negative toner is transferred from the transfer roller 5 onto the photosensitive drum 1, the optical discharge is not effected before the charging process, whereby stable negative electric charges are maintained without excessively charging the negative toner during the charging process.

As a result, the toner transferred from the transfer roller 5 onto the photosensitive drum 1 can be reliably collected by the developing device 4 without causing deposition thereof on the photosensitive drum 1 (drum fusion). For this reason, it is possible to provide an image for which image defect such that a portion where the toner is deposited in the dot shape is formed in the unintended region and image defect such that a portion where the dot-shaped toner is not deposited is formed in the unintended region are suppressed. Further, by preventing the toner from depositing on the photosensitive drum 1 more than necessary, a lifetime of the photosensitive drum 1 is also prolonged.

Incidentally, the pre-exposure device 6 in this embodiment has a constitution in which the photosensitive drum 1 is directly irradiated with light of the LED which is the pre-exposure means, but is not limited thereto. The pre-exposure device 6 may also have a constitution in which fur tips of a brush member consisting of electroconductive fibers, such as a fur brush or may also be disposed so that the photosensitive drum surface is irradiated with light through a light guide which is an optical discharging element. Further, in the case where an irradiation angle is formed as in the case of the light guide, although ON/OFF timing of the pre-exposure device 6 is different, as described above, the ON/OFF control may only be regulated to be effected appropriately depending on the polarity of the toner transferred from the transfer roller 5 onto the photosensitive drum 1. Accordingly, for example, the pre-exposure device 6 may also be turned on at timing when a leading end the positive toner transferred from the transfer roller 5 onto the photosensitive drum 1 reaches the charging portion a.

Further, in states in which the negative toner is transferred onto the photosensitive drum 1 at timings (C) to (E) and (G) to (I), the pre-exposure device 6 may also be not necessarily be turned off. That is, when a potential difference between the charging roller 5 and the surface of the photosensitive drum 1 after passed through the discharging portion e is at a level where the potential difference little causes the electric discharge, the negative toner can pass through the charging portion a as it is without being substantially subjected to the electric discharge at the charging portion a, and therefore the electric discharge may also be effected to some extent.

Further, in this embodiment, the case where the present invention is applied to the image forming apparatus of the DC charging type was described as an example, but the present invention is also applicable to an image forming apparatus of an AC charging type in which as the charging voltage, an oscillating voltage in the form of a DC voltage (DC component) is biased with an AC voltage (AC component) is used.

In this embodiment, with respect to the developing voltage, only the DC component was described, but the developing voltage may also be an oscillating voltage in the form of a DC voltage (DC component) is biased with an AC voltage (AC component).

In this embodiment, the charging member was described as the roller-shaped member, but is not limited thereto. For example, also a rotatable member in another shape, such as an endless belt-shaped charging member wound around a plurality of supporting rollers (e.g., in which one of the plurality of supporting rollers is contacted to the belt toward the photosensitive drum) can be suitably used.

In this embodiment, the cleaning operation of the transfer roller 5 was described as being performed in the post-rotation step during the non-image formation, but is not limited thereto. The cleaning operation can be executed at any timing if the timing is in a period of the non-image formation. For example, in the above-described embodiment, in the case where the number of sheets subjected to image output is a predetermined threshold or more in a certain job, the cleaning operation of the transfer roller 5 was executed in the post-rotation step after all the image formation in the job is ended. However, in the case where the number of sheets subjected to image output is the predetermined threshold or more during the job, the cleaning operation of the transfer roller 5 can be executed in an extended sheet interval or the like.

Further, in this embodiment, as the developer, the toner which is the magnetic one-component developer was used, but the developer may also be a non-magnetic one-component developer.

Modified Embodiment 1

A modified embodiment of Embodiment 1 described above will be described. In Embodiment 1, the cleaning operation of the transfer roller 5 was executed in the post-rotation step performed during non-image formation. On the other hand, in this Modified Embodiment 1, in an image forming apparatus 100 having the same constitution as in Embodiment 1, the cleaning operation is executed in a pre-rotation step performed during non-image formation. In the constitution of the image forming apparatus 100 used in this Modified Embodiment 1, members (portions) identical to those in Embodiment 1 are represented by the same reference numerals or symbols and will be omitted from description.

In this modified embodiment, as the transfer bias, the following 3 biases "HIGH1", "HIGH2" and "LOW" are used.

HIGH1: ATVC set bias . . . about +1000 V

HIGH2: Image leading end bias . . . +1100 V

LOW: Cleaning bias . . . −1100 V

<ON/OFF Control of Pre-Exposure Device 6>

Figure 13:
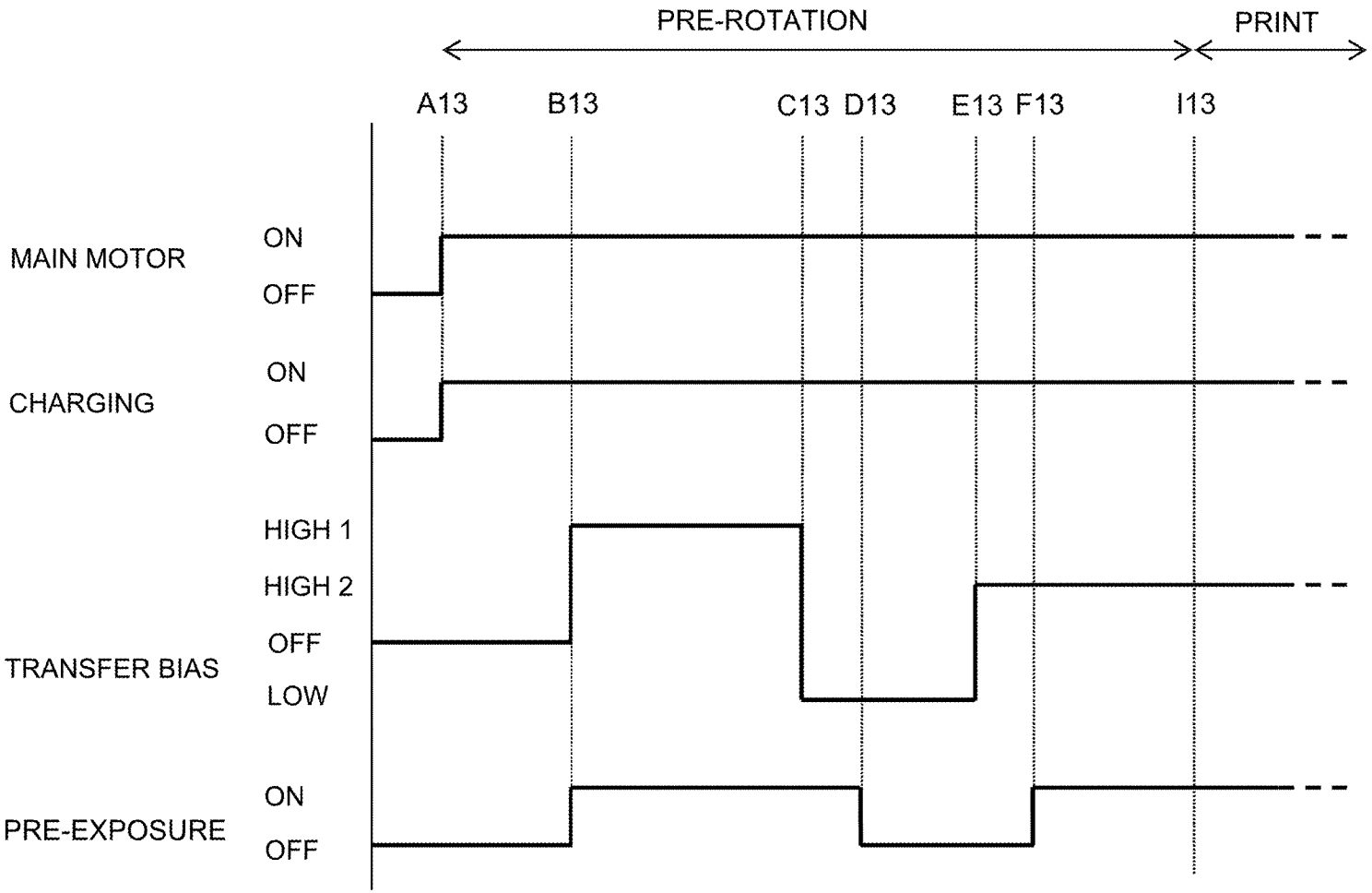
FIG. 13 is a timing chart of a cleaning operation in Modified Embodiment of Embodiment 1.

FIG. 13 shows a timing chart of the cleaning operation of the transfer roller 5 in this modified embodiment. The cleaning operation of the transfer roller 5 is executed by controlling operations of respective portions by the controller 150 at timings shown in FIG. 13. In this modified embodiment, in the pre-rotation step, after transfer ATVC (active transfer voltage control), the cleaning operation of the transfer roller 5 is executed until the recording material P reaches the transfer portion d. Here, the ATVC is a control method for meeting fluctuations in durability and environment of an electrical resistance of the transfer roller 5. In this control method, a transfer bias subjected to constant-current control with a value set in advance is applied to the transfer roller 5 during non-image formation, and a fluctuation in generated voltage value at this time is detected, so that a fluctuation in electrical resistance value is detected.

Timing (A13):

When the image forming apparatus 100 receives an instruction of a printing operation from an unshown external device, the sequence enters the pre-rotation step in which a preparatory operation before an operation in an image forming step is performed (A13 of FIG. 13). At this timing (A13), the main motor is driven, and the charging bias and drive of the unshown high-voltage sources and the scanner motor are turned on.

Timing (B13):

Then, at timing (B13 of FIG. 13) when a region of the photosensitive drum 1 under application of the charging bias to the charging roller 2 reaches the transfer portion d, the transfer bias is turned on and is increased to HIGH1 (ATVC set value), and then the pre-exposure device 6 is turned on. Thereafter, the transfer ATVC is effected from timing (not shown) when the transfer bias increases to a desired ATVC set value, so that the fluctuation in electrical resistance value is detected. During execution of this transfer ATVC, the transfer roller 5 collects the fog toner on the photosensitive drum 1. On the photosensitive drum 1, the fog toner is deposited by sliding (friction) due to rotational drive of the developing sleeve 41. Particularly, after the image forming apparatus 100 is in a sleep state or the like, electric charges of the toner on the developing sleeve 41 are unstable, and therefore the toner is liable to be transferred as the fog toner onto the photosensitive drum 1. The fog toner on the photosensitive drum 1 is transferred onto the transfer roller 5 at the transfer portion d by electrostatic or physical sliding.

Incidentally, the reason why the pre-exposure device 6 is turned on at the timing (B13) is that the toner which is transferred from the transfer roller 5 onto the photosensitive drum 1 after the transfer bias is applied and which has no electric charge and the toner having positive electric charge are charged to the negative polarity by the electric discharge at the charging portion a and then are collected in the developing device 4.

Timing (C13)

Then, at timing (C13 of FIG. 13) when the transfer ATVC is ended, the transfer bias is switched from HIGH1 (ATVC set value) to LOW (−1100 V). At this time, the surface potential on the photosensitive drum 1 is changed uniformly to the dark-portion potential (−700 V). For this reason, from the timing (B13 of FIG. 13) when the transfer bias is switched to LOW, the negative fog toner contained in the transfer roller 5 is electrostatically attracted to the surface of the photosensitive drum 1, so that the negative toner is transferred from the transfer roller 5 onto the photosensitive drum 1.

Timing (D13):

Then, at timing (D13 of FIG. 13) when the negative toner transferred from the transfer roller 5 onto the photosensitive drum 1 after the transfer bias is switched to LOW reaches the discharging portion e, the pre-exposure device 6 is turned off. That is, the timing (D13) is timing when a portion positioned at the transfer portion d at the timing (C13) of the photosensitive drum 1 has reached the discharging portion e. From this timing, the optical discharge is not effected at the discharging portion e, and therefore the surface potential of the photosensitive drum 1 is kept at −700 V. The region of the photosensitive drum 1 where the surface potential of −700 V is kept little causes the electric discharge since a potential difference between the region of the photosensitive drum 1 and the charging roller is small. Accordingly, the negative toner transferred from the transfer roller 5 onto the photosensitive drum 1 passes through the charging portion a as it is without being less subjected to the electric discharge at the charging portion a, and is transferred onto the developing sleeve 41 at the developing portion c by a potential from the developing bias (−300 V), and thus are collected in the developing device 4.

Timing (E13):

Then, at timing (E13 of FIG. 13) when the photosensitive drum 1 is rotated corresponding to about one-full-circumference of the transfer roller 5 after the transfer bias is switched to LOW, the transfer bias is switched from LOW (−1100 V) to HIGH2 (+1100 V) which is an image leading end bias.

Incidentally, the timing when the transfer bias is switched from LOW to HIGH2 may preferably be at least after rotation of the transfer roller 5 through one-full-circumference in order to enable cleaning of a full circumference of the transfer roller 5. Further, the transfer bias value is LOW: −1100 V, but is not limited thereto. The transfer bias value LOW may only be required to be a voltage reliability high in the negative polarity side against a variation of the surface potential (−700 V) of the photosensitive drum 1, and may only be required to be a bias value such that the negative toner contained in the transfer roller 5 is transferred onto the photosensitive drum 1 with reliability.

Timing (F13):

Then, at timing (F13 of FIG. 13) when the positive toner transferred from the transfer roller 5 onto the photosensitive drum 1 after the transfer bias is switched to HIGH2 (+1000 V) reaches the discharging portion e, the pre-exposure device 6 is turned on again. The timing (F13) is timing which a portion positioned at the transfer portion d at the timing (E13) of the photosensitive drum 1 reaches the discharging portion e. From this timing, the optical discharge is effected again at the discharging portion e, so that the surface potential on the photosensitive drum 1 is changed to −100 V. As a result, in a subsequent printing step (113 and later of FIG. 13), the transfer residual toner which is not completely transferred onto the photosensitive drum 1 at the transfer portion d can be charged to the negative polarity by the electric discharge at the charging portion a. The toner charged to the negative polarity is sent to the developing portion c with the rotation of the photosensitive drum 1 and then is transferred from the photosensitive drum 1 onto the developing sleeve 41 by a positive toner difference between the dark-portion potential (Vd) of the surface of the photosensitive drum 1 and the developing bias (Vdc), so that the toner is collected in the developing device 4. On the other hand, the toner in the image region (exposed region) is not transferred onto the developing sleeve 41 due to a potential difference between the light-portion potential (Vl) of the surface of the photosensitive drum 1 and the developing bias (Vdc), so that the toner is sent as an image portion to the transfer portion d as it is with the rotation of the photosensitive drum 1 and then is transferred onto the recording material P.

Functional Effect of this Embodiment

As described above, according to this embodiment, in the cleaning operation of the transfer roller 5 in the post-rotation step, when the positive toner is transferred from the transfer roller 5 onto the photosensitive drum 1, uniform electric discharge is generated during the charging process after the optical discharge by the pre-exposure device 6 is effected. Further, when the negative toner is transferred from the transfer roller 5 onto the photosensitive drum 1, the optical discharge is not effected before the charging process, whereby stable negative electric charges are maintained without excessively charging the negative toner during the charging process.

As a result, the toner transferred from the transfer roller 5 onto the photosensitive drum 1 can be reliably collected by the developing device 4 without causing deposition thereof on the photosensitive drum 1 (drum fusion), so that it is possible to provide an image for which image defect due to the drum fusion is suppressed. Further, by preventing the toner from depositing on the photosensitive drum 1 more than necessary, a lifetime of the photosensitive drum 1 is also prolonged.

Embodiment 2

An image forming apparatus according to Embodiment 2 will be described. The image forming apparatus 100 in this embodiment is not provided with the pre-exposure device 6 as in Embodiment 1, but the charging bias is made variable depending on the polarity of the toner transferred from the transfer roller 5 onto the photosensitive drum 1, so that stable negative electric charges are imparted to the toner after passed through the charging portion a. In the constitution of the image forming apparatus 100 used in this embodiment, members (portions) identical to those in Embodiment 1 are represented by the same reference numerals or symbols and will be omitted from description.

In this embodiment, as the transfer bias, the following 3 biases "HIGH", "LOW1" and "LOW2" are used.

HIGH: Image trailing end bias . . . +1000 V

LOW1: Cleaning bias . . . +200 V

LOW2: Cleaning bias . . . −1200 V

<Charging Bias Control>

Figure 14:
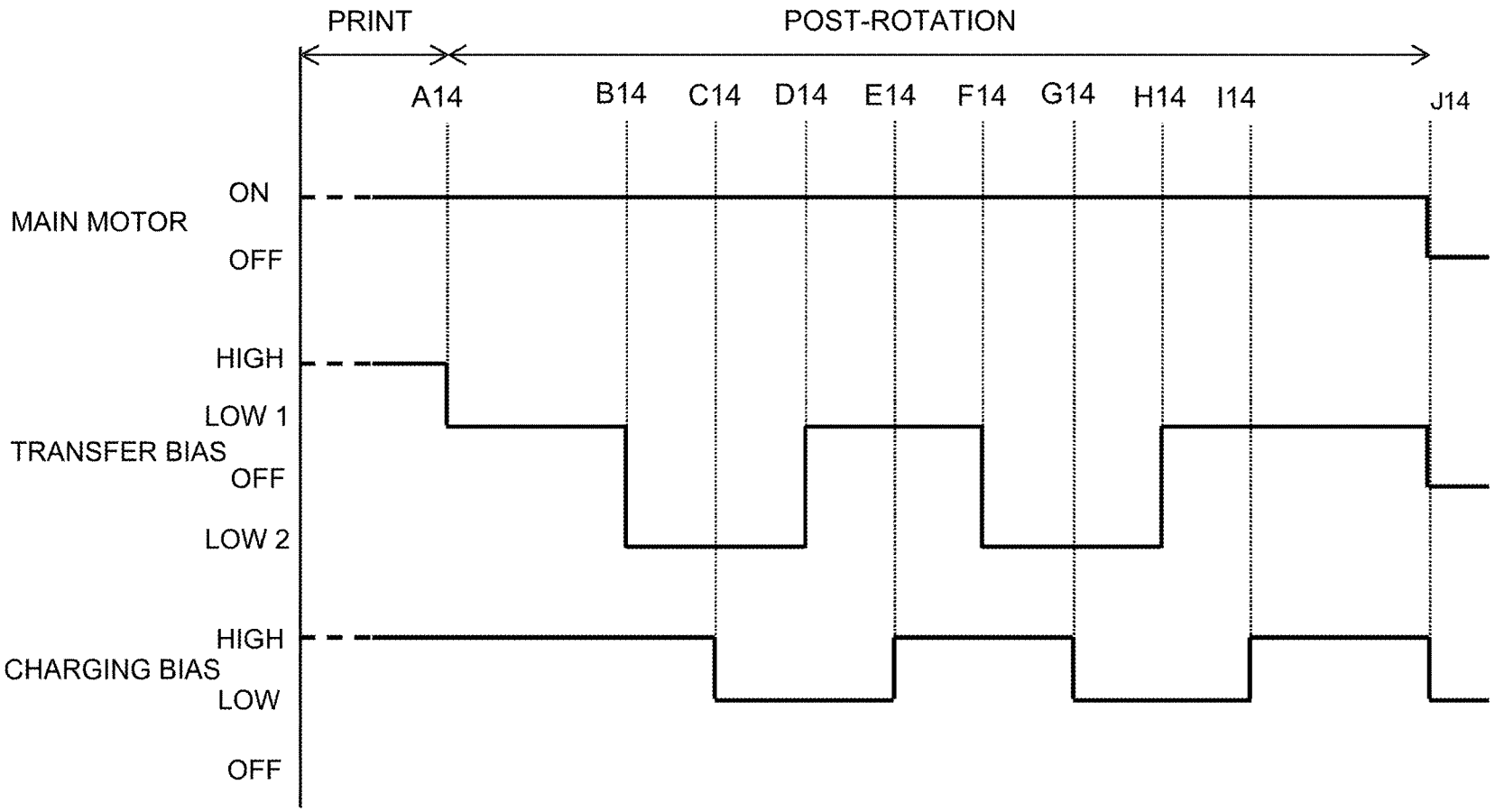
FIG. 14 is a timing chart of a cleaning operation in Embodiment 2.

FIG. 14 shows a timing chart of the cleaning operation of the transfer roller 5 in this embodiment. Similarly as in Embodiment 1, the cleaning operation of the transfer roller 5 is executed by controlling operations of respective portions by the controller 150 at timings shown in FIG. 14. In this embodiment, in the case where the number of sheets subjected to image output is not less than a predetermined threshold, in the post-rotation step, the cleaning operation of the transfer roller 5 is carried out. At each timing, control similar to the control in Embodiment 1 will be omitted from detailed description.

Timing (A14):

The printing step is ended, and then at timing (A14 of FIG. 14), the transfer bias is switched from HIGH (+1000 V) to LOW1 (+200 V). Similarly as Embodiment 1, after the recording material P passed through the transfer portion d, of the toners contained in the transfer roller 5, the positive (polarity) toner is principally electrostatically attracted to the surface of the photosensitive drum 1, so that the positive toner is transferred from the transfer roller 5 onto the photosensitive drum 1 (α of FIG. 4). The charging bias is kept at HIGH (−1200 V) which is the same as that in the printing step, and therefore the positive toner transferred from the transfer roller 5 onto the photosensitive drum 1 is charged to the negative polarity by the electric discharge at the charging portion a.

Incidentally, the charging bias at this timing was HIGH (−1200 V) which is the same as that in the printing step, but in order to increase a degree of the electric discharge at the charging portion a, the charging bias may also be further increased in the negative polarity side.

Figure 15:
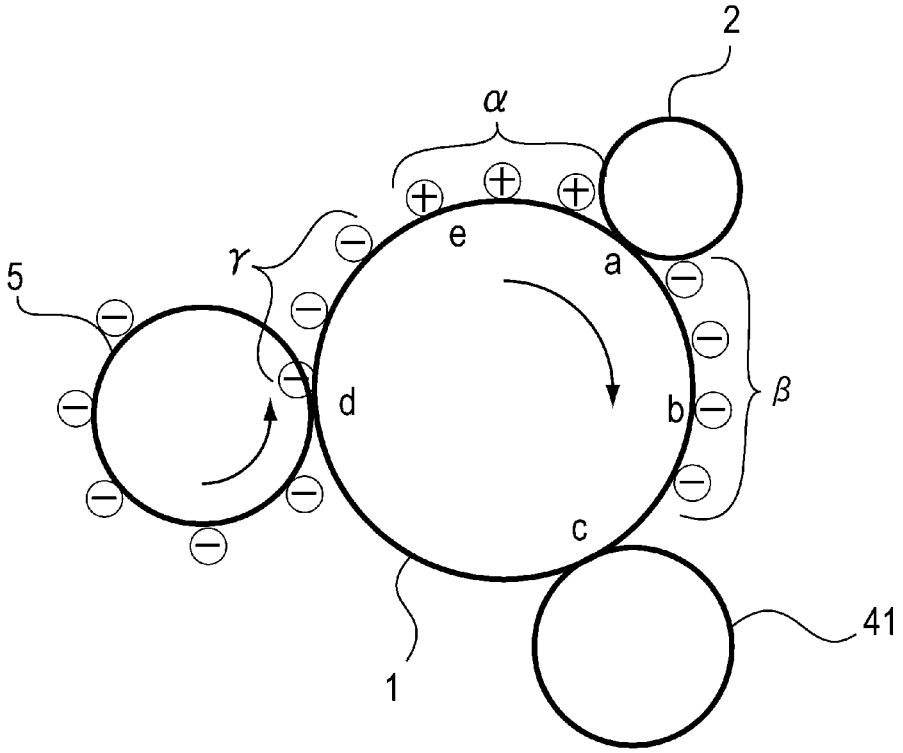
FIG. 15 is a schematic view for illustrating a state during the cleaning operation in Embodiment 2.

Timing (B14):

Then, at timing (B14 of FIG. 14) when the photosensitive drum 1 is rotated corresponding to about one-full-circumference of the transfer roller 5 after the transfer bias is switched to LOW1, the transfer bias is switched from LOW1 (+200 V) to LOW2 (−1200 V). From this timing of the toners contained in the transfer roller 5, the negative (polarity) toner is principally electrostatically attracted to the surface of the photosensitive drum 1, so that the negative toner is transferred from the transfer roller 5 onto the photosensitive drum 1. Accordingly, on the photosensitive drum 1, the negative toner (γ of FIG. 6) transferred from the transfer roller 5 after the switching to LOW1 follows the positive toner (α of FIG. 15) transferred from the transfer roller 5 after the transfer bias is LOW1 in a downstream side as shown in FIG. 15. Further, the toner (β of FIG. 15) passed through the charging portion a is charged to the negative polarity (β of FIG. 6) by the electric discharge at the charging portion a.

Timing (C14):

Then, at timing (C14 of FIG. 14) when the positive toner (α) transferred from the transfer roller 5 onto the photosensitive drum 1 when the transfer bias is LOW1 passed through the charging portion a, the charging bias is switched from HIGH (−1200 V) to LOW (−1000 V). The timing (C14) is timing when a portion positioned at the transfer portion d at the timing (B) of the photosensitive drum 1 has reached the charging portion a. That is, an absolute value of the voltage applied to the charging roller is made smaller than that of the voltage value during image formation. Incidentally, the value of the voltage applied to the charging roller is a voltage value to the extent that the electric discharge is not generated at the charging portion a. Further, the voltage applied to the charging roller is switched to the voltage value to the extent that the electric discharge is not generated at the charging portion a before the negative polarity (normal polarity in this embodiment) toner (γ) reaches the charging portion a. From this timing, the negative toner (γ) transferred from the transfer roller 5 onto the photosensitive drum 1 passes through the charging portion a as it is without being substantially subjected to the electric discharge at the charging portion a. That is, when the region where the negative toner (γ) exists passes through the charging portion a, to the charging roller 2, the voltage of −1000 V larger in absolute value than the image bearing member (photosensitive drum) surface potential of −700 V and smaller in absolute value than the voltage of −1200 V during the image formation in the normal polarity (negative polarity) side is applied. As a result, the toner passed through the charging portion a rotates while having stable negative electric charges, and then is transferred onto the developing sleeve 41 at the developing portion c by a potential difference from the developing bias (−300 V), and thus is collected in the developing device 4.

Incidentally, the developing bias in this embodiment is −300 V, but can also be appropriately changed in order to more facilitate electrostatic attraction of the negative toner on the photosensitive drum 1.

Timing (D14):

Then, at timing (D14 of FIG. 14) when the photosensitive drum 1 is rotated corresponding to about one-full-circumference of the transfer roller 5 after the transfer bias is switched to LOW2, the transfer bias is switched from LOW2 (−1200 V) to LOW1 (+200 V). From this timing, the positive toner remaining in the transfer roller 5 is electrostatically attracted to the surface of the photosensitive drum 1, so that the positive toner is transferred from the transfer roller onto the photosensitive drum 1.

Timing (E14):

Then, at timing (E14 of FIG. 14) when the positive toner (α) transferred from the transfer roller 5 onto the photosensitive drum 1 after the transfer bias is switched to LOW1 reaches the charging portion a, the charging bias is switched again from LOW (−1000 V) to HIGH (−1200 V). The timing (E14) is timing which a portion positioned at the transfer portion d at the timing (D14) of the photosensitive drum 1 reaches the charging portion a. From this timing, the electric discharge is generated again at the charging portion a, so that the positive toner (α) transferred from the transfer roller 5 onto the photosensitive drum 1 is charged to the negative polarity.

Timing (F14):

Then, at timing (F14 of FIG. 14) when the photosensitive drum 1 is rotated corresponding to about one-full-circumference of the transfer roller 5 after the transfer bias is switched again to LOW1, the transfer bias is switched from LOW1 (+200 V) to LOW2 (−1200 V). From the timing, the negative toner (γ) remaining in the transfer roller 5 is electrostatically attracted to the surface of the photosensitive drum 1, so that the negative toner is transferred from the transfer roller 5 onto the photosensitive drum 1.

Timing (G14):

Then, at timing (G14 of FIG. 14) when the positive toner (α) transferred from the transfer roller 5 onto the photosensitive drum 1 when the transfer bias is LOW1 has completely passed through the charging portion a, the charging bias is switched again from HIGH (−1200 V) to LOW (−1000 V). The timing (G14) is timing when a portion positioned at the transfer portion d at the timing (F14) of the photosensitive drum 1 has reached the charging portion a. From this timing and later, the negative toner (γ) transferred from the transfer roller 5 onto the photosensitive drum 1 passes through the charging portion a without being substantially subjected to the electric discharge at the charging portion a.

Timing (H14):

Then, at timing (H14 of FIG. 3) when the photosensitive drum 1 is rotated corresponding to about one-full-circumference of the transfer roller 5 after the transfer bias is switched again to LOW2, the transfer bias is switched from LOW2 (−1200 V) to LOW1 (+200 V). At this timing (H14) the negative toner contained in the transfer roller 5 is substantially removed, and therefore, the cleaning operation of the transfer roller 5 is ended.

Timing (I14):

Then, at timing (I14 of FIG. 14) when the positive toner (α) remaining in the transfer roller 5 reaches the charging portion a after the transfer bias is switched to LOW1, the charging bias is switched again from LOW (−1000 V) to HIGH (−1200 V). The timing (I14) is timing when a portion positioned at the transfer portion d at the timing (H14) of the photosensitive drum 1 has reached the charging portion a. As a result, the region where the positive toner (α) transferred from the transfer roller 5 onto the photosensitive drum 1 is charged to the negative polarity by the electric discharge at the charging portion a and then is collected in the developing device 4.

Timing (J14):

Finally, at timing (J14 of FIG. 14) when all the negative toners transferred from the transfer roller 5 onto the photosensitive drum 1 when the transfer bias is LOW2 are collected in the developing device 4, the transfer bias and drive of all of the unshown high-voltage sources, a main motor, a scanner motor and the like are turned off, so that the post-rotation step is ended.

Functional Effect of this Embodiment

As described above, according to this embodiment, in the cleaning operation of the transfer roller 5 in the post-rotation step, when the negative toner is transferred from the transfer roller 5 onto the photosensitive drum 1, the absolute value of the charging bias is made small compared with when the positive toner is transferred, so that the electric discharge at the charging portion a is prevented from generating. As a result, stable negative electric charges are maintained with no excessive charge of the negative toner during the charging process.

As a result, the toner transferred from the transfer roller 5 onto the photosensitive drum 1 can be reliably collected by the developing device 4 without causing deposition thereof on the photosensitive drum 1 (drum fusion), so that, it is possible to provide an image in which image defect due to the drum fusion is suppressed. Further, by preventing the toner from depositing on the photosensitive drum 1 more than necessary, a lifetime of the photosensitive drum 1 is also prolonged.

In this embodiment, the cleaning operation of the transfer roller 5 was described as being performed in the post-rotation step during the non-image formation, but is not limited thereto. The cleaning operation can be executed at any timing if the timing is in a period of the non-image formation. For example, in the above-described embodiments, in the case where the number of sheets subjected to image output is a predetermined threshold or more in a certain job, the cleaning operation of the transfer roller 5 was executed in the post-rotation step after all the image formation in the job is ended. However, in the case where the number of sheets subjected to image output is the predetermined threshold or more during the job, the cleaning operation of the transfer roller 5 can be executed in an extended sheet interval or the like.

Further, in the above-described embodiments, as the image forming apparatus, the printer was described as an example, the present invention is not limited thereto, but the image forming apparatus may also be other image forming apparatuses such as a copying machine, a facsimile machine and a multi-function machine having functions of these machines in combination. By applying the present invention to these image forming apparatuses, a similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-198376 filed on Oct. 6, 2015, which is hereby incorporated by reference herein in its entirety.

What is claimed is:

1. An image forming apparatus comprising:

a rotatable image bearing member;

a charging member for charging a surface of said image bearing member at a charging portion opposing said image bearing member;

a developing member for forming a developing portion in contact with said image bearing member and for forming a toner image to said image bearing member by developing a toner charged to a normal polarity at the developing portion;

a transfer member for forming a transfer portion in contact with said image bearing member and for transferring the toner image from said image bearing member onto a recording material at the transfer portion;

an exposure unit for exposing the surface of said image bearing member in a downstream side of the transfer portion and a upstream side of the charging portion with respect to a rotating direction of said image bearing member;

a charging voltage source for applying a charging voltage to said charging member;

a developing voltage source for applying a developing voltage to said developing member;

a transfer voltage source for applying a transfer voltage to said transfer member; and a control unit for controlling said exposure unit, said charging voltage source, said developing voltage source and said transfer voltage source, wherein said control unit controls to perform a first operation to form the toner image onto the recording material at the transfer portion, and to perform a second operation to rotate said transfer member and said image bearing member in contact with each other rather than in the first operation, wherein the toner remaining on said image bearing member without being transferred onto the recording material is collected by said developing member in the first operation, and wherein the second operation performed by said control unit includes:

(i) a first process for passing an area of said image bearing member charged to the normal polarity by said charging member through the transfer portion in a state in which the transfer voltage is applied to the transfer portion so as to form a potential difference between said transfer member and said image bearing member, which acts as an electrostatic force directed to the direction from said transfer member to said image bearing member to the toner charged to the normal polarity;

(ii) a second process for performing exposure to the area after the first process by an exposure amount smaller than an exposure amount exposed by said exposure unit in the first process or not for performing exposure to the area after the first process, (iii) a third process for passing the area after the second process through the charging portion in a state in which the charging voltage is applied to the charging portion so as to form a potential difference between said charging member and said image bearing member, which does not generate an electric discharge between said charging member and said image bearing member but acts as an electrostatic force directed to the direction from said charging member to said image bearing member to the toner charged to the normal polarity;

(iv) a forth process for reaching the area after the third process to the developing portion in a state in which the developing voltage is applied to the developing portion so as to form a potential difference which acts as an electrostatic force directed to the direction from said image bearing member to said developing member to the toner charged to the normal polarity.

2. The image forming apparatus according to claim 1, wherein said control unit controls to perform a cleaning operation to clean said transfer member by moving the toner charged to the normal polarity from said transfer member to said image bearing member in the second operation.

3. The image forming apparatus according to claim 1, wherein the second operation performed by said control unit includes:

(v) a fifth process for passing an area of said image bearing member charged to the normal polarity by said charging member through the transfer portion in a state in which the transfer voltage is applied to the transfer portion so as to form a potential difference between said transfer member and said image bearing member, which acts as an electrostatic force directed to the direction from said image bearing member to said transfer member to the toner charged to the normal polarity;

(vi) a sixth process for performing exposure to the area after the fifth process, (vii) a seventh process for passing the area after the sixth process through the charging portion in a state in which the charging voltage is applied to the charging portion so as to form a potential difference between said charging member and said image bearing member, which generates the electric discharge between said charging member and said image bearing member and acts as an electrostatic force directed to the direction from said charging member to said image bearing member to the toner charged to the normal polarity;

(viii) an eighth process for reaching the area after the third process to the developing portion in a state in which the developing voltage is applied to the developing portion so as to form a potential difference which acts as an electrostatic force directed to the direction from said image bearing member to said developing member to the toner charged to the normal polarity.

4. The image forming apparatus according to claim 3, wherein said control unit controls to perform a cleaning operation to clean said transfer member by moving the toner charged to an opposite polarity to the normal polarity from said transfer member to said image bearing member in the second operation.

5. The image forming apparatus according to claim 3, wherein said control unit controls said exposure unit so that the exposure amount exposed by said exposure unit in the sixth process is larger than that in the second process.

6. The image forming apparatus according to claim 3, wherein said control unit controls to perform a cleaning operation to clean said transfer member by moving the toner from said transfer member to said image bearing member in the second operation, and wherein said control unit controls so that a first transfer operation in which the toner charged to the normal polarity transfers from said transfer member to said image bearing member is performed after a second transfer operation in which the toner charged to an opposite polarity to the normal polarity transfers from said transfer member to said image bearing member is performed.

7. The image forming apparatus according to claim 3, wherein the second operation is performed in a pre-rotation step executed after the first operation.

8. The image forming apparatus according to claim 3, wherein the second operation is performed in a post-rotation step executed after the first operation.

9. The image forming apparatus according to claim 3, wherein the toner supplied from said developing member is a one-component developer.

10. The image forming apparatus according to claim 3, wherein the toner supplied from said developing member is a magnetic one-component developer.

11. The image forming apparatus according to claim 1, wherein said control unit controls the charging voltage source so that an absolute value of the charging voltage applied to the charging member in the third process is smaller than that in the first process.

12. The image forming apparatus according to claim 1, wherein said control unit controls the charging voltage source so that the charging voltage applied to the charging member in the third process is equal to that in the first process.

13. An image forming apparatus comprising:

a rotatable image bearing member;

a charging member for charging a surface of said image bearing member at a charging portion opposing said image bearing member;

a developing member for forming a developing portion in contact with said image bearing member and for forming a toner image to said image bearing member by developing a toner charged to a normal polarity at the developing portion;

a transfer member for forming a transfer portion in contact with said image bearing member and for transferring the toner image from said image bearing member onto a recording material at the transfer portion;

an exposure unit for exposing the surface of said image bearing member in a downstream side of the transfer portion and a upstream side of the charging portion with respect to a rotating direction of said image bearing member;

a voltage source for applying a voltage to said charging member; and a control unit for controlling said exposure unit and said voltage source, wherein said control unit controls to perform a first operation to form the toner image onto the recording material at the transfer portion, a second operation which includes a first transfer process for transferring the toner charged to the normal polarity from said transfer member to said image bearing member, a passing process for passing the toner transferred to said image bearing member through the charging portion, and a collecting process for collecting the toner passed through the charging portion by said developing member at the developing portion, a third operation which includes a second transfer process for transferring the toner charged to an opposite polarity to the normal polarity from said transfer member to said image bearing member, the passing process and the collecting process;

wherein the toner remaining on said image bearing member without being transferred onto the recording material is collected by said developing member in the first operation, and wherein in the passing process of the third operation in a state in which a potential difference is formed, which acts as an electrostatic force directed to the direction from said image bearing member to said charging member to the toner charged to the normal polarity, the toner passes through the charging portion in a state in which the voltage is applied to said charging member so as to form a potential difference which generates an electric discharge between said image bearing member said charging member in the passing process of the third operation and to form the potential difference larger than that in the passing process of the second operation, and the toner is collected by said developing member in the collecting process.

14. The image forming apparatus according to claim 13, wherein the second operation is performed in a pre-rotation step executed after the first operation.

15. The image forming apparatus according to claim 13, wherein the second operation is performed in a post-rotation step executed after the first operation.

16. The image forming apparatus according to claim 13, wherein the toner supplied from said developing member is a one-component developer.

17. The image forming apparatus according to claim 13, wherein the toner supplied from said developing member is a magnetic one-component developer.

* * * * *